US011051632B1

(12) United States Patent
Lantz

(10) Patent No.: US 11,051,632 B1
(45) Date of Patent: Jul. 6, 2021

(54) MULTI-HEIGHT TABLE AND CHAIR SET

(71) Applicant: Kellie Lantz, Weymouth, MA (US)

(72) Inventor: Kellie Lantz, Weymouth, MA (US)

( * ) Notice: Subject to any disclaimer, the term of this patent is extended or adjusted under 35 U.S.C. 154(b) by 0 days.

(21) Appl. No.: 16/813,841

(22) Filed: Mar. 10, 2020

(51) Int. Cl.
*A47C 31/00* (2006.01)
*A47C 3/36* (2006.01)
*A47B 9/16* (2006.01)

(52) U.S. Cl.
CPC ..... *A47C 31/008* (2013.01); *A47B 9/16* (2013.01); *A47C 3/36* (2013.01); *A47B 2200/0056* (2013.01)

(58) Field of Classification Search
CPC .. A47B 3/063; A47B 3/10; A47B 3/14; A47B 9/16; A47B 2200/1156; A47B 39/00; A47B 83/02; A47C 31/008; A47C 3/36; B66F 1/06; B66F 7/12
USPC ..... 297/135, 139; 108/145; 254/124
See application file for complete search history.

(56) References Cited

U.S. PATENT DOCUMENTS 1,457,041 A * 5/1923 Orear ..... A47B 3/14 190/12 A
1,622,327 A * 3/1927 Livingood ..... A47C 4/00 297/139
4,237,795 A 12/1980 Parker
4,558,648 A * 12/1985 Franklin ..... B66F 7/065 108/136
4,577,821 A * 3/1986 Edmo ..... B66F 7/08 108/145
4,926,760 A * 5/1990 Sack ..... B65G 1/07 108/145
5,556,163 A * 9/1996 Rogers, III ..... A47C 1/023 297/330
6,974,123 B2 * 12/2005 Latvys ..... B66F 7/065 254/122
8,286,944 B2 * 10/2012 Rossato ..... B66F 7/0666 254/122
9,833,079 B2 12/2017 Souders
9,854,913 B1 1/2018 Lin
10,258,148 B1 * 4/2019 Donner ..... A47B 9/18
2004/0201261 A1 10/2004 Johnson
2007/0261612 A1 11/2007 Alcov
2015/0084383 A1 * 3/2015 Zhu ..... A47B 3/06 297/139

(Continued)

FOREIGN PATENT DOCUMENTS

DE 29917299 U1 * 12/1999 ..... A47C 7/5068
DE 102016115244 A1 * 3/2017 ..... A47C 7/506

(Continued)

*Primary Examiner* — Jose V Chen
(74) *Attorney, Agent, or Firm* — Kyle A. Fletcher, Esq.

(57) ABSTRACT

The multi-height table and chair set is a kit. The multi-height table and chair set comprises a table structure and one or more chair structures. The table structure is a furniture item known as a table. Each of the one or more chair structures is a furniture item known as a chair. The chair is defined elsewhere in this disclosure. The multi-height table and chair set is configured for use with a personal data device. The personal data device remotely controls the elevation of the tabletop of the table structure. The personal data device remotely controls the elevation of the bench of each of the one or more chair structures. The table structure is formed from a master structure. Each of one or more chair structures is formed from the master structure.

17 Claims, 6 Drawing Sheets

(56) References Cited

U.S. PATENT DOCUMENTS

| | | | | |
|---|---|---|---|---|
| 2015/0351529 | A1* | 12/2015 | Riley | A47C 7/727<br>297/135 |
| 2018/0020831 | A1* | 1/2018 | Lenz | A47B 9/10<br>297/174 R |
| 2018/0199716 | A1* | 7/2018 | Bertinato | A47C 31/008 |
| 2018/0279769 | A1* | 10/2018 | Zheng | A47B 21/02 |
| 2018/0279770 | A1* | 10/2018 | Crowe | A47B 9/10 |
| 2018/0301918 | A1* | 10/2018 | Lupo | H02J 7/00 |
| 2018/0311809 | A1* | 11/2018 | Chen | A47B 9/10 |
| 2019/0231079 | A1* | 8/2019 | Schulte | G06F 3/167 |

FOREIGN PATENT DOCUMENTS

| | | | | |
|---|---|---|---|---|
| KR | 20150006721 | A * | 1/2015 | A47C 3/36 |
| WO | 2016128142 | | 8/2016 | |
| WO | WO-2017084984 | A1 * | 5/2017 | A47C 20/041 |
| WO | WO-2017132240 | A1 * | 8/2017 | H04Q 9/04 |

* cited by examiner

MULTI-HEIGHT TABLE AND CHAIR SET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including tables and chairs, more specifically, a bench or counter with adjustable elevation. (A47C3/38)

SUMMARY OF INVENTION

The multi-height table and chair set is a kit. The multi-height table and chair set comprises a table structure and one or more chair structures. The table structure is a furniture item known as a table. Each of the one or more chair structures is a furniture item known as a chair. The multi-height table and chair set is configured for use with a personal data device. The personal data device remotely controls the elevation of the tabletop of the table structure. The personal data device remotely controls the elevation of the bench of each of the one or more chair structures. The table structure is formed from a master structure. Each of one or more chair structures is formed from the master structure.

These together with additional objects, features and advantages of the multi-height table and chair set will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-height table and chair set in detail, it is to be understood that the multi-height table and chair set is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-height table and chair set.

It is therefore important that the claims be regarded as including such equivalent construction insofar as they do not depart from the spirit and scope of the multi-height table and chair set. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
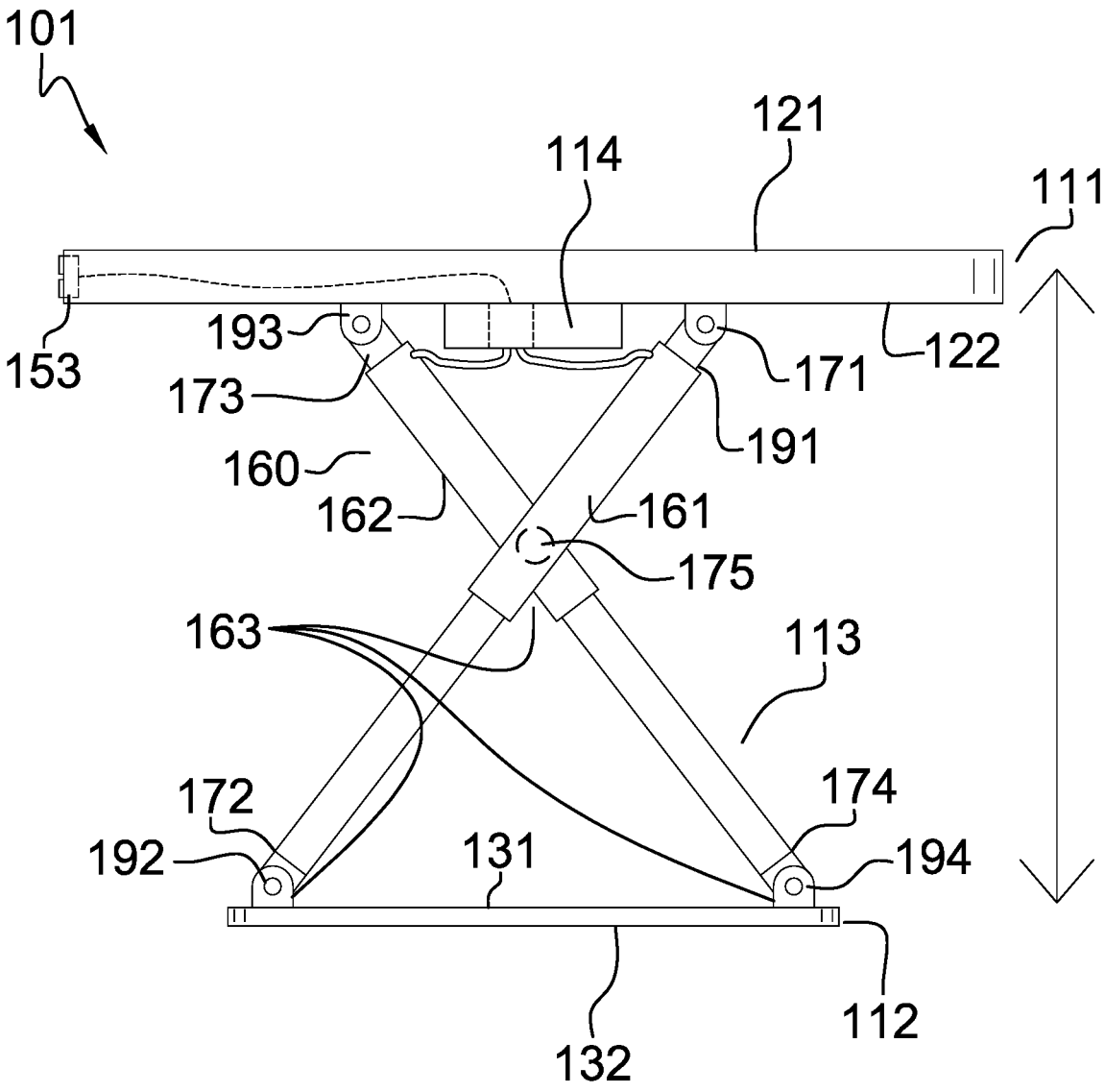
FIG. 1 is a front view of an embodiment of the disclosure.
Figure 2:
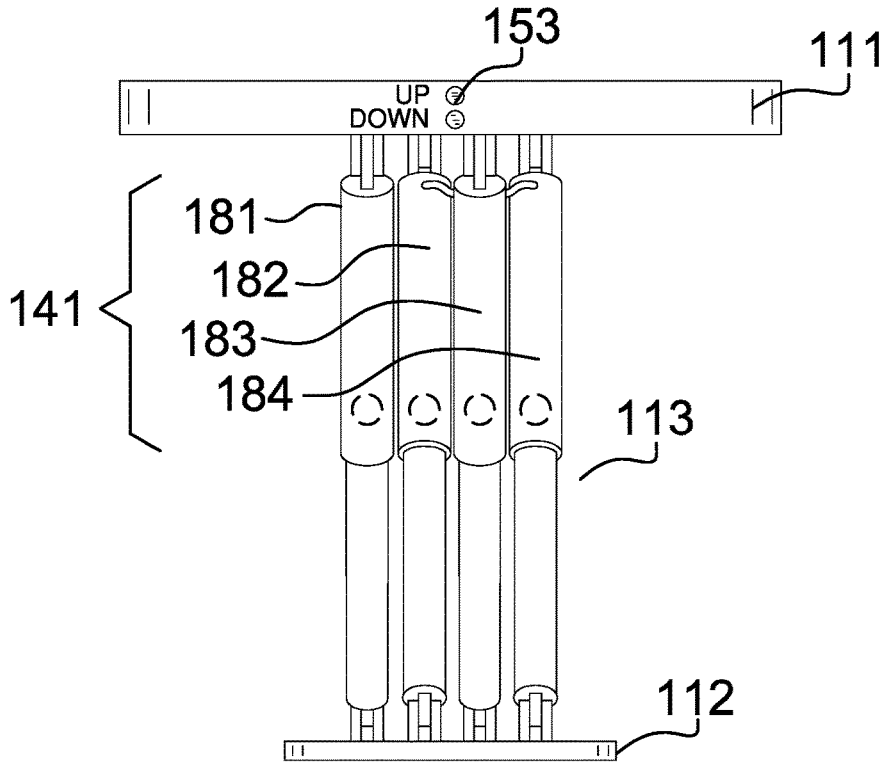
FIG. 2 is a side view of an embodiment of the disclosure.
Figure 3:
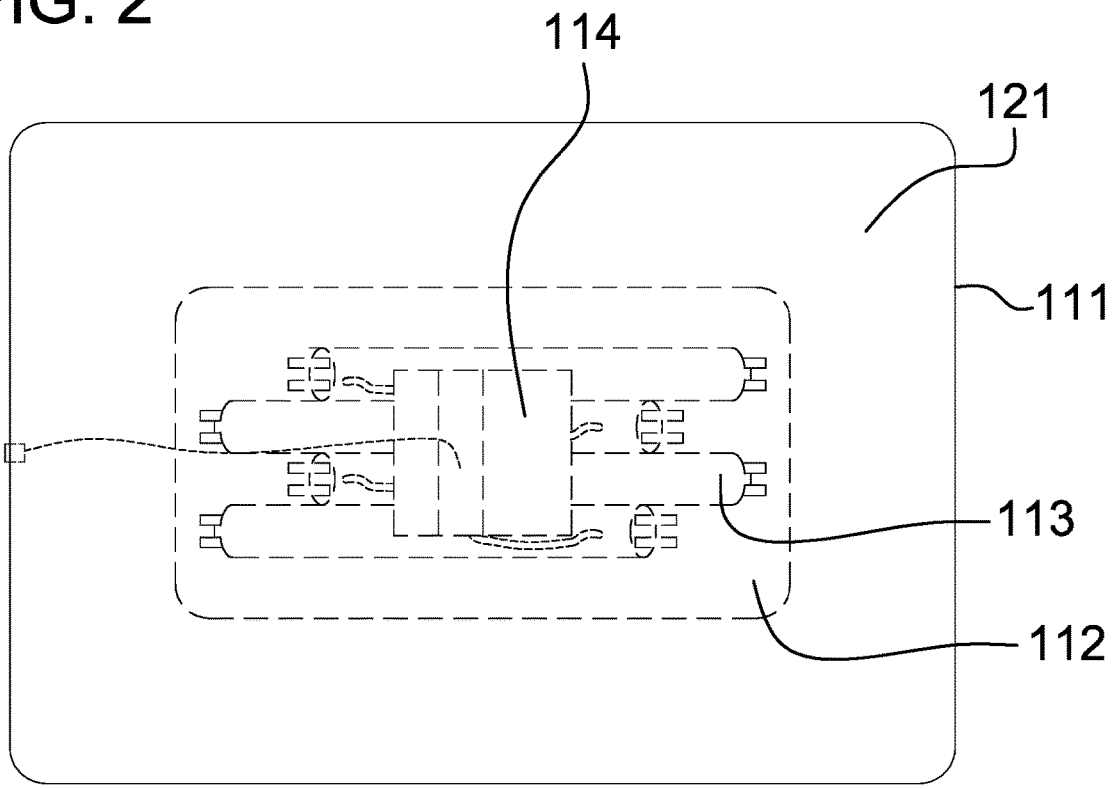
FIG. 3 is a top view of an embodiment of the disclosure.
Figure 4:
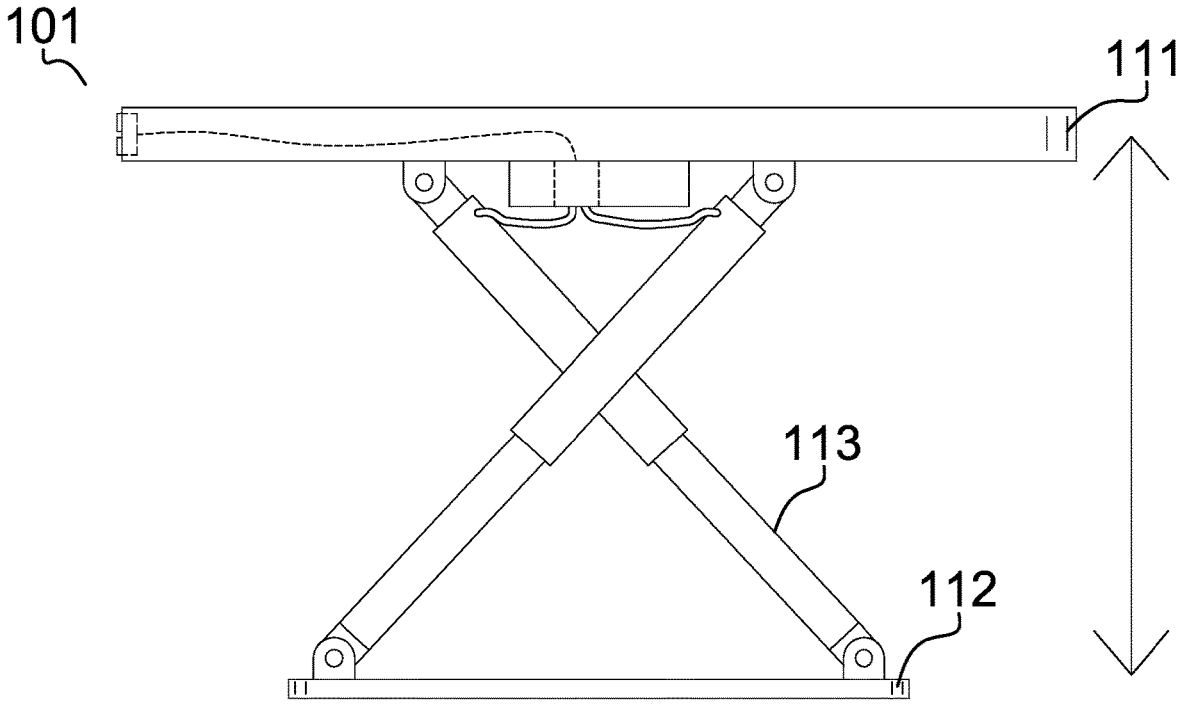
FIG. 4 is a front view of an alternate position of the disclosure.
Figure 5:
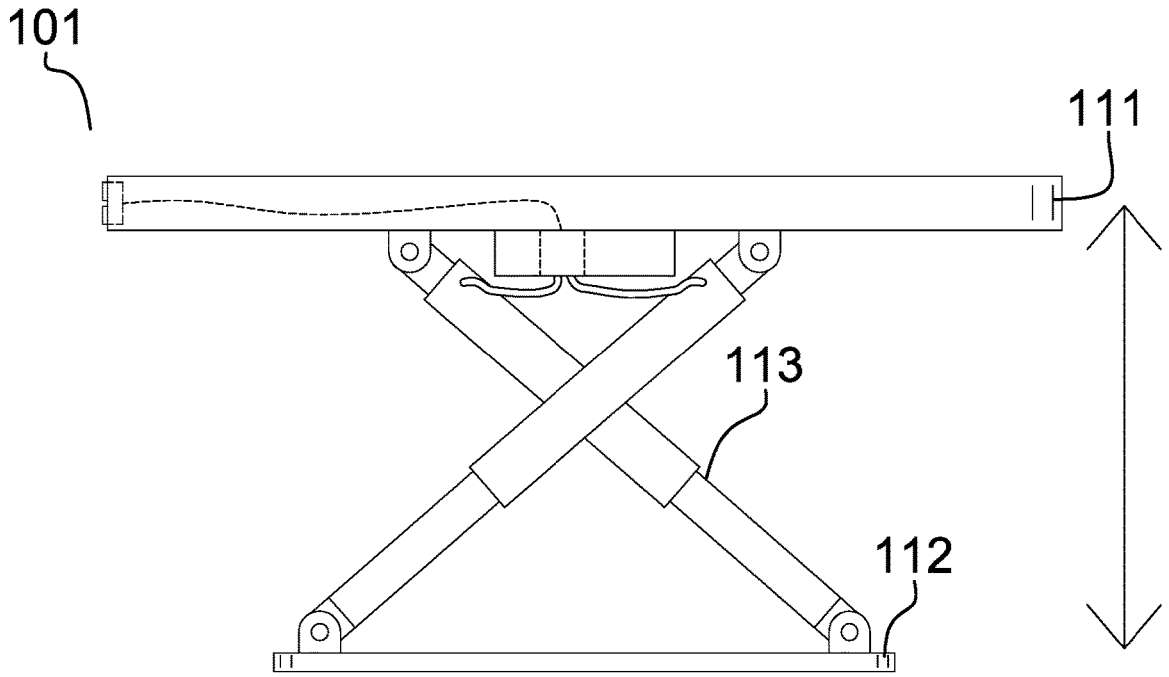
FIG. 5 is a front view of an alternate position of the disclosure.
Figure 6:
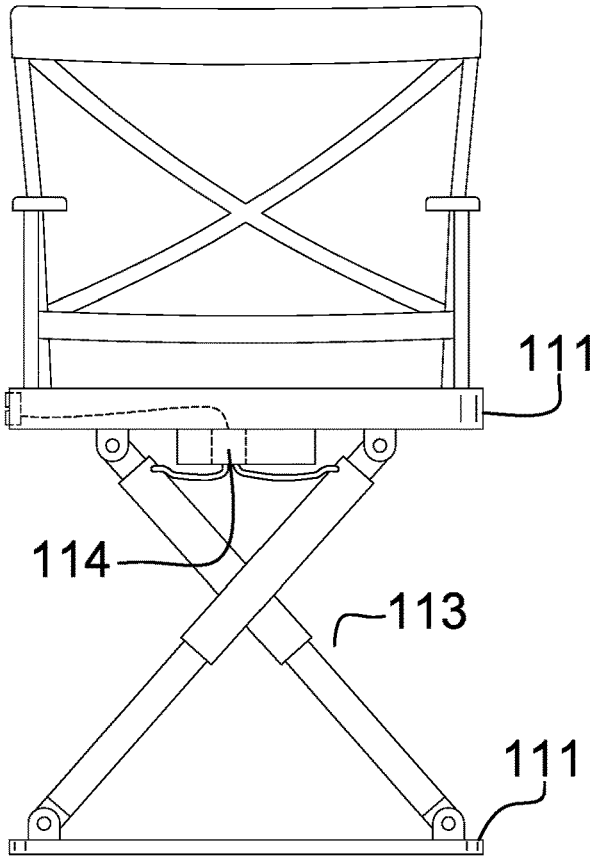
FIG. 6 is a front view of an embodiment of the disclosure.
Figure 7:
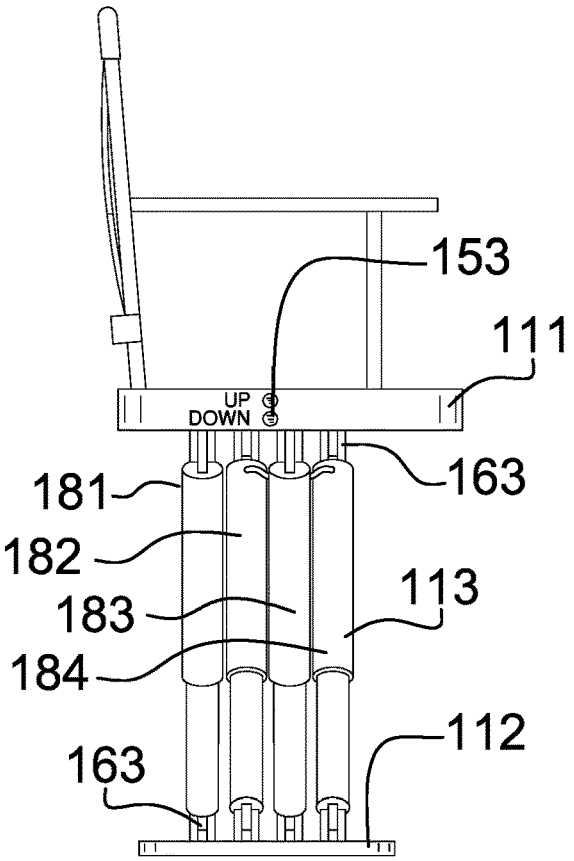
FIG. 7 is a side view of an embodiment of the disclosure.
Figure 8:
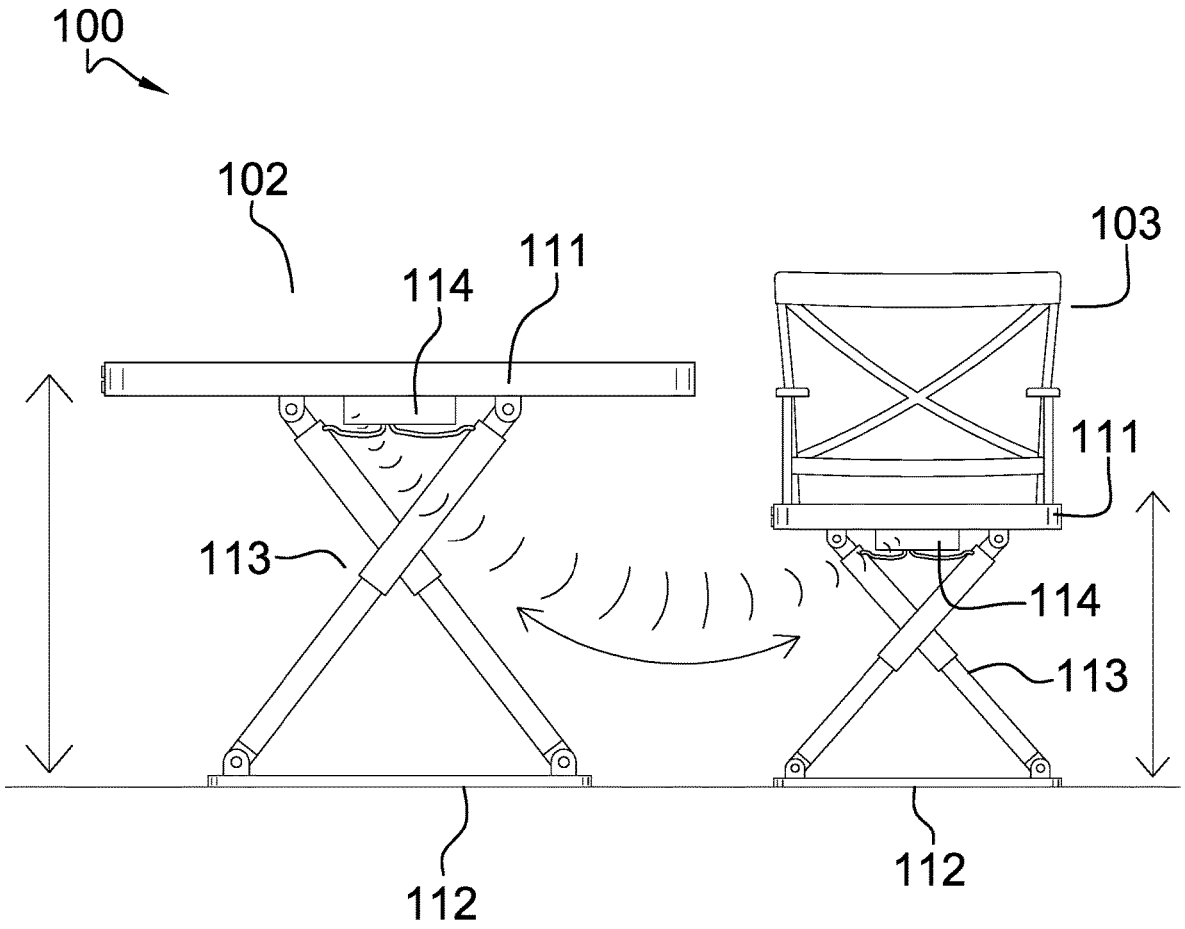
FIG. 8 is an in-use view of an embodiment of the disclosure.
Figure 9:
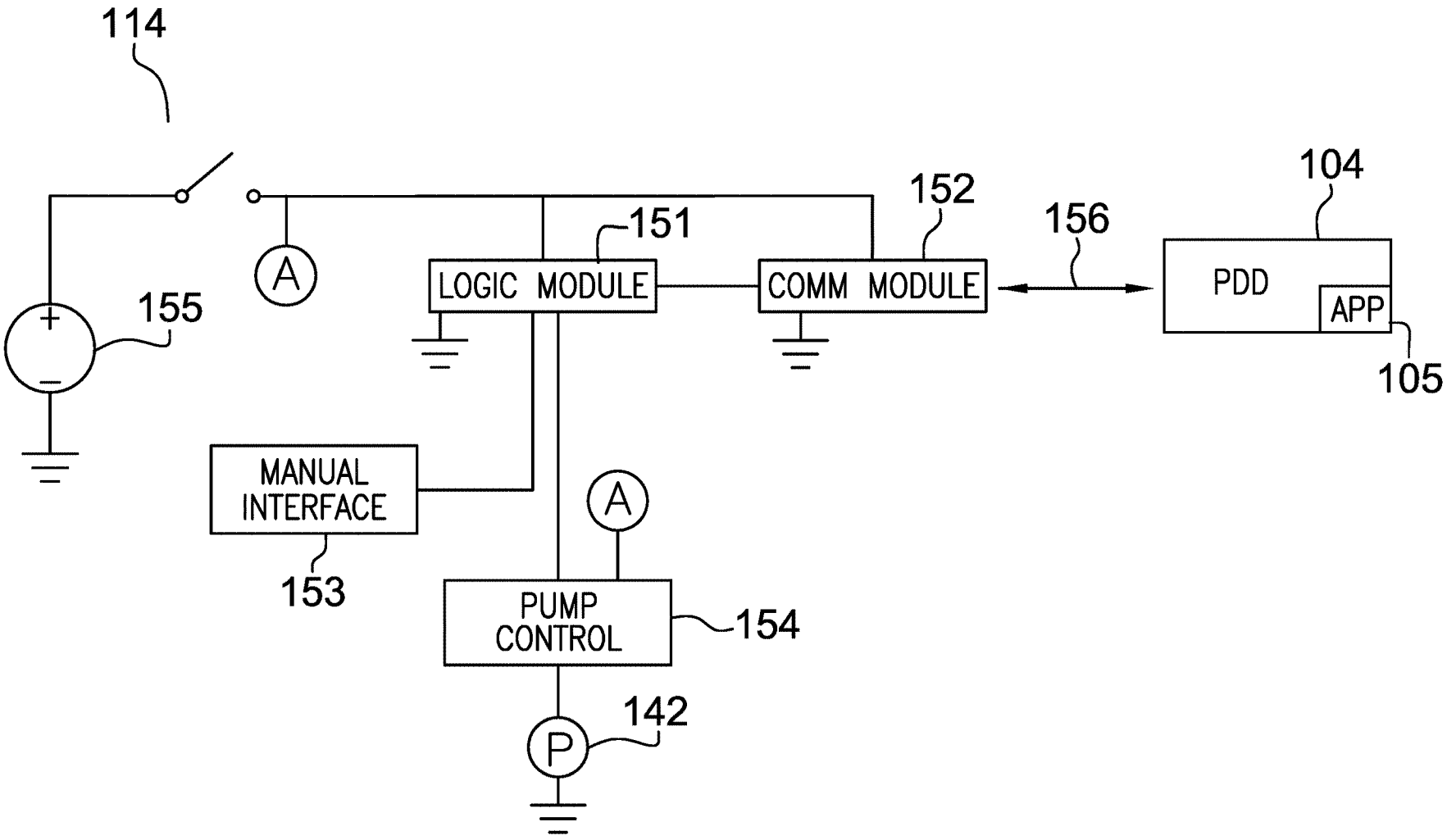
FIG. 9 is a block diagram of an embodiment of the disclosure.

Detailed reference will now be made to one or more potential embodiments of the disclosure, which are illustrated in FIGS. 1 through 9.

The multi-height table and chair set 100 (hereinafter invention) is a kit. The invention 100 comprises a table structure 102 and one or more chair structures 103. The table structure 102 is a furniture item known as a table. The table is defined elsewhere in this disclosure. Each of the one or more chair structures 103 is a furniture item known as a chair. The invention 100 is configured for use with a personal data device 104. The personal data device 104 remotely controls the elevation of the tabletop of the table structure 102. The personal data device 104 remotely controls the elevation of the bench of each of the one or more chair structures 103. The table structure 102 is formed from a master structure 101. Each of one or more chair structures 103 is formed from the master structure 101.

The personal data device 104 is a programmable electrical device that provides data management and communication services through one or more functions referred to as an application 105. The application 105 is a set of logical operating instructions that are performed by the personal data device 104. The addition of an application 105 will provide increased functionality for the personal data device 104. This disclosure assumes that an application 105 exists for the purpose of providing operating instructions to the invention 100. Methods to design and implement an application 105 on a personal data device 104 are well known and documented in the electrical arts.

The master structure 101 is a mechanical structure. The master structure 101 forms the base structure of the table structure 102. The master structure 101 forms the base structure of each of the one or more chair structures 103. The elevation of the superior surface of the master structure 101 is adjustable. The personal data device 104 controls the operation of the master structure 101. The master structure 101 comprises a counter 111, a pedestal 112, a bridge lift 113, and a control circuit 114.

The counter 111 is a disk-shaped structure. The counter 111 forms a load bearing horizontal surface. The counter 111 forms the superior horizontal surface of the master structure 101. The counter 111 forms the initial link of the load path that supports any object placed on the counter 111. The counter 111 is defined elsewhere in this disclosure. The counter 111 comprises a counter superior surface 121 and a counter inferior surface 122.

The counter superior surface 121 is a congruent end of the disk structure of the counter 111. The counter superior surface 121 is the congruent end of the counter 111 that is distal from the counter inferior surface 122. The counter inferior surface 122 is a congruent end of the disk structure of the counter 111. The counter inferior surface 122 is the congruent end of the counter 111 that is proximal to the pedestal 112. The bridge lift 113 attaches to the counter inferior surface 122 of the counter 111.

The pedestal 112 is a disk-shaped structure. The pedestal 112 forms a load bearing horizontal surface. The pedestal 112 forms the inferior structure of the master structure 101. The pedestal 112 forms the final link of the load path formed by the master structure 101 between the counter 111 and a supporting surface. The pedestal 112 is defined elsewhere in this disclosure. The pedestal 112 comprises a pedestal superior surface 131 and a pedestal inferior surface 132.

The pedestal superior surface 131 is a congruent end of the disk structure of the pedestal 112. The pedestal superior surface 131 is the congruent end of the pedestal 112 that is proximal to the counter 111. The bridge lift 113 attaches to the pedestal superior surface 131 of the pedestal 112. The pedestal inferior surface 132 is a congruent end of the disk structure of the pedestal 112. The pedestal inferior surface 132 is the congruent end of the pedestal 112 that is distal from the pedestal superior surface 131.

The counter 111 and the pedestal 112 attach to the bridge lift 113. The bridge lift 113 is an extension apparatus. The bridge lift 113 is a mechanical device. The bridge lift 113 adjusts the elevation of the counter 111. The bridge lift 113 is designed to maintain the horizontal orientation of the counter 111 as the bridge lift 113 changes the elevation of the counter 111. The bridge lift 113 comprises a plurality of jack structures 141 and a pump 142.

The plurality of jack structures 141 form a hydraulic structure. The plurality of jack structures 141 provide the motive forces that change the elevation of the counter 111 of the master structure 101. Each of the plurality of jack structures 141 are hydraulically controlled. Each of the plurality of jack structures 141 is identical. Each of the plurality of jack structures 141 is a rotating structure. The plurality of jack structures 141 comprises a collection of individual jack structures 160. Each individual jack structure 160 comprises a first hydraulic piston 161, a second hydraulic piston 162, and a plurality of hinges 163. The first hydraulic piston 161 is further defined with a first end 191 and a second end 192. The second hydraulic piston 162 is further defined with a third end 193 and a fourth end 194.

The first end 191 is an end of the first hydraulic piston 161 of the individual jack structure 160. The second end 192 is an end of the first hydraulic piston 161 of the individual jack structure 160 that is distal from the first end 191. The third end 193 is an end of the second hydraulic piston 162 of the individual jack structure 160. The fourth end 194 is an end of the second hydraulic piston 162 of the individual jack structure 160 that is distal from the third end 193.

The pump 142 is a mechanical structure that generates a pressure within a fluid network. The pump 142 changes the pressure of a hydraulic fluid contained in a fluid network. The pump 142 provides the motive forces necessary to change the elevation of the counter 111. The pump 142 adjusts the elevation of the counter 111 by changing the pressure of the hydraulic fluid within the fluid network. Specifically, the span of the length of each jack structure selected from the plurality of jack structures 141 adjusts by adjusting the pressure of the hydraulic fluid contained in the fluid network. The rotating nature of the plurality of jack structures 141 allows the orientations within each jack structure to adjust in a manner that allows the plurality of jack structures 141 to elevate the counter 111 of the master structure 101.

Each individual jack structure 160 is a jack structure selected from the plurality of jack structures 141. Each individual jack structure 160 is a rotating mechanical device. Each individual jack structure 160 forms a portion of the load path between the counter 111 and the pedestal 112. Each individual jack structure 160 is identical.

The first hydraulic piston 161 is a mechanically driven structure. The first hydraulic piston 161 is a hydraulically driven structure. The span of the length of the first hydraulic piston 161 varies as a function of the hydraulic pressure provided by the pump 142 to the plurality of jack structures 141. The second hydraulic piston 162 is a mechanically driven structure. The second hydraulic piston 162 is a hydraulically driven structure. The span of the length of the second hydraulic piston 162 varies as a function of the hydraulic pressure provided by the pump 142 to the plurality of jack structures 141. The second hydraulic piston 162 is identical to the first hydraulic piston 161. The second hydraulic piston 162 attaches to the first hydraulic piston 161 such that the second hydraulic piston 162 rotates relative to the first hydraulic piston 161.

Each of the plurality of hinges 163 makes an attachment selected from the group consisting of: a) attaching the lateral face of the first hydraulic piston 161 to the lateral face of the second hydraulic piston 162; b) attaching an end of a hydraulic piston selected from the group consisting of the first hydraulic piston 161 and the second hydraulic piston 162 to the counter inferior surface 122 of the counter 111; c) attaching an end of a hydraulic piston selected from the group consisting of the first hydraulic piston 161 and the second hydraulic piston 162 to the pedestal superior surface 131 of the pedestal 112.

The plurality of hinges 163 comprises a first hinge 171, a second hinge 172, a third hinge 173, a fourth hinge 174, and a fifth hinge 175.

The first hinge 171 is a fastening structure. The first hinge 171 is a rotating structure. The first hinge 171 attaches the first end 191 of the first hydraulic piston 161 to the counter inferior surface 122 of the counter 111 such that the first hydraulic piston 161 rotates relative to the counter inferior surface 122.

The second hinge 172 is a fastening structure. The second hinge 172 is a rotating structure. The second hinge 172 attaches the second end 192 of the first hydraulic piston 161 to the pedestal superior surface 131 of the pedestal 112 such that the first hydraulic piston 161 rotates relative to the pedestal superior surface 131.

The third hinge 173 is a fastening structure. The third hinge 173 is a rotating structure. The third hinge 173 attaches the third end 193 of the second hydraulic piston 162 to the counter inferior surface 122 of the counter 111 such that the second hydraulic piston 162 rotates relative to the counter inferior surface 122.

The fourth hinge 174 is a fastening structure. The fourth hinge 174 is a rotating structure. The fourth hinge 174 attaches the fourth end 194 of the second hydraulic piston 162 to the pedestal superior surface 131 of the pedestal 112 such that the second hydraulic piston 162 rotates relative to the pedestal superior surface 131.

The fifth hinge 175 is a fastening structure. The fifth hinge 175 is a rotating structure. The fifth hinge 175 attaches the lateral face of the first hydraulic piston 161 to the lateral face of the second hydraulic piston 162 such that the first hydraulic piston 161 rotates relative to the second hydraulic piston 162.

The plurality of jack structures 141 further comprises a first jack structure 181, a second jack structure 182, third jack structure 183, and a fourth jack structure 184.

The first jack structure 181 is a jack structure selected from the plurality of jack structures 141 that transfers a portion of the load of the counter 111 to the pedestal 112. The second jack structure 182 is a jack structure selected from the plurality of jack structures 141 that transfers a portion of the load of the counter 111 to the pedestal 112. The second jack structure 182 is identical to the first jack structure 181.

The third jack structure 183 is a jack structure selected from the plurality of jack structures 141 that transfers a portion of the load of the counter 111 to the pedestal 112. The third jack structure 183 is identical to the second jack structure 182. The fourth jack structure 184 is a jack structure selected from the plurality of jack structures 141 that transfers a portion of the load of the counter 111 to the pedestal 112. The fourth jack structure 184 is identical to the third jack structure 183.

The control circuit 114 is an electric circuit. The control circuit 114 controls the operation of the bridge lift 113. The control circuit 114 provides the forces necessary to allow the bridge lift 113 to change the elevation of the counter 111 of the master structure 101. The personal data device 104 controls the operation of the control circuit 114. The control circuit 114 comprises a logic module 151, a communication module 152, a manual interface 153, a pump control 154, and an external power source 155. The communication module 152 further comprises a wireless communication link 156. The logic module 151, the communication module 152, the manual interface 153, the pump control 154 and the external power source are electrically interconnected. The wireless communication link 156 establishes a communication link between the control circuit 102 and the personal data device 104.

The logic module 151 is a readily and commercially available programmable electronic device that is used to manage, regulate, and operate the control circuit 114. Depending on the specific design and the selected components, the logic module 151 can be a separate component within the control circuit 114 or the functions of the logic module 151 can be incorporated into another component within the control circuit 114. The communication module 152 is a wireless electronic communication device that allows the logic module 151 to wirelessly communicate with a personal data device 104. Specifically, the communication module 152 establishes a wireless communication link 156 between the control circuit 114 and the personal data device 104. In the first potential embodiment of the disclosure the communication module 152 supports a communication protocol selected from the group consisting of a WiFi™ protocol or a Bluetooth™ protocol.

The manual interface 153 is a collection of electrical switches. The manual interface 153 allows for the manual adjustment of the elevation of the counter 111 of the master structure 101 when the operation of the personal data device 104 has been disabled. The pump control 154 is an electric circuit that forms a motor control device. The logic module 151 controls the operation of the pump control 154. The pump control 154 electrically controls the operation of the pump 142. The external power source 155 is an externally provided source of electrical energy.

The table structure 102 is a table that is formed from the master structure 101. The counter 111 of the master structure 101 forms the tabletop of the table formed by the table structure 102.

Each of the one or more chair structures 103 is a chair that is formed from the master structure 101. The counter 111 of the master structure 101 forms the bench of each chair formed by the one or more chair structures 103.

The following definitions were used in this disclosure:

Application or App: As used in this disclosure, an application or app is a self-contained piece of software that is especially designed or downloaded for use with a personal data device.

Backrest: As used in this disclosure, a backrest is a vertical or vertically canted supporting surface formed in a chair or seat.

Bench: As used in this disclosure, a bench is a horizontal supporting surface formed by a chair.

Bluetooth™: As used in this disclosure, Bluetooth™ is a standardized communication protocol that is used to wirelessly interconnect electronic devices.

Bridge Lift: As used in this disclosure, a bridge lift is a mechanical device that raises and lowers a horizontal platform such that the horizontal surface of the horizontal platform retains its orientation relative to the force of gravity.

Cant: As used in this disclosure, a cant is an angular deviation from one or more reference lines (or planes) such as a vertical line (or plane) or a horizontal line (or plane).

Chair: As used in this disclosure, a chair is a structure that a person can sit on. The horizontal resting surface a person sits on is called the bench. Seat is a common synonym for a chair.

Communication Link: As used in this disclosure, a communication link refers to the structured exchange of data between two objects.

Counter: As used in this disclosure, a counter is a horizontal surface a working space for a project. A counter is further defined with an inferior surface and a superior surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Apparatus: As used in this disclosure, an extension apparatus is a mechanical structure that is used to extend or bridge the reach between any two objects.

Extension Structure: As used in this disclosure, an extension structure is an inert physical structure that is used to extend or bridge the reach between any two objects.

External Power Source: As used in this disclosure, an external power source is a source of the energy that is externally provided to enable the operation of the present disclosure. Examples of external power sources include, but are not limited to, electrical power sources and compressed air sources.

Fluid Network: As used in this disclosure, a fluid network refers to a transport structure that: a) receives a fluid into the fluid network; b) transports the fluid through a series of pipes, valves, and manifold; and, c) discharges the fluid from the fluid network.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Hinge: As used in this disclosure, a hinge is a device that permits the turning, rotating, or pivoting of a first object relative to a second object. A hinge designed to be fixed into a set position after rotation is called a locking hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hydraulic: As used in this disclosure, hydraulic refers to a device wherein the movement of the device is powered using a fluid under pressure.

Inferior: As used in this disclosure, the term inferior refers to a directional reference that is parallel to and in the same direction as the force of gravity when an object is positioned or used normally.

Interface: As used in this disclosure, an interface is a physical or virtual boundary that separates two different systems across which information is exchanged.

Jack: As used in this disclosure, a jack is a mechanical device for lifting heavy loads by means of a force applied with a lever, screw, or hydraulic press.

Kit: As used in this disclosure, a kit is an assembly of a combination of instruments, equipment, or supplies that are dedicated or intended for use in a specific purpose. Depending on the context, a kit may further include the container within which the instruments, equipment, and supplies are stored.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Orientation: As used in this disclosure, orientation refers to the positioning of a first object relative to: 1) a second object; or, 2) a fixed position, location, or direction.

PDD: As used in this disclosure, PDD is an acronym for personal data device.

Pedestal: As used in this disclosure, a pedestal is an intermediary load bearing structure that that forms a load path between a supporting surface and an object, structure, or load.

Personal Data Device: As used in this disclosure, a personal data device is a handheld logical device that is used for managing personal information and communication. Examples of personal data device include, but are not limited to, cellular phones, tablets, and smartphones.

Pipe: As used in this disclosure, the term pipe is used to describe a rigid hollow prism. While pipes that are suitable for use in this disclosure are often used to transport or conveys fluids or gases, the purpose of the pipes in this disclosure are structural. In this disclosure, the terms inner dimension of a pipe and outer dimension are used as they would be used by those skilled in the plumbing arts would use inner diameter and outer diameter.

Piston: As used in this disclosure, a piston is a prism or disk that closely fits within a pipe or tube and that moves along the center axis of the pipe or tube. Depending on the context, a piston can also refer to the apparatus associated with the disk that allows the disk to move within the pipe or tube.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reach: As used in this disclosure, reach refers to a span of distance between any two objects.

Remote Control: As used in this disclosure, remote control means the establishment of control of a device from a distance. Remote control is generally accomplished through the use of an electrical device that generates electrically based control signals that are transmitted via radio frequencies or other means to the device.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Table: As used in this disclosure, a table is a furniture item that provides a horizontal surface raised above a supporting surface. The raised horizontal surface is often called the tabletop. The table is an extension apparatus that forms a load path between items placed on the horizontal surface raised and the supporting surface on which the table rests.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-height table and chair set comprising
a table structure and one or more chair structures;
wherein the multi-height table and chair set is a kit;
wherein the table structure is a furniture item known as a table;
wherein each of the one or more chair structures is a furniture item known as a chair;
wherein the multi-height table and chair set is configured for use with a personal data device;
wherein the personal data device remotely controls the elevation of the tabletop of the table structure;
wherein the personal data device remotely controls the elevation of the bench of each of the one or more chair structures;
wherein the table structure is formed from a master structure;
wherein each of one or more chair structures is formed from the master structure;
wherein the master structure comprises a counter, a pedestal, a bridge lift, and a control circuit;
wherein the bridge lift attaches the counter to the pedestal;
wherein the control circuit controls the operation of the bridge lift;
wherein the bridge lift comprises a plurality of jack structures and a pump;
wherein the plurality of jack structures form a hydraulic structure;
wherein the plurality of jack structures provide motive forces that change the elevation of the counter of the master structure;
wherein each of the plurality of jack structures is hydraulically controlled;
wherein each of the plurality of jack structures is identical;
wherein each of the plurality of jack structures is a rotating structure;
wherein the pump is a mechanical structure that generates a pressure within a fluid network;
wherein the pump changes the pressure of a hydraulic fluid contained in a fluid network;
wherein the pump provides the motive forces necessary to change the elevation of the counter;
wherein the pump adjusts the elevation of the counter by changing the pressure of the hydraulic fluid within the fluid network;
wherein specifically, the span of the length of each jack structure selected from the plurality of jack structures adjusts by adjusting the pressure of the hydraulic fluid contained in the fluid network;
wherein the rotating nature of the plurality of jack structures allows the orientations within each jack structure to adjust in a manner that allows the plurality of jack structures to elevate the counter of the master structure.

2. The multi-height table and chair set according to claim 1
wherein the master structure is a mechanical structure;
wherein the elevation of a superior surface of the master structure is adjustable;
wherein the personal data device controls the operation of the master structure.

3. The multi-height table and chair set according to claim 2 wherein the counter is a disk-shaped structure;

wherein the counter forms a load bearing horizontal surface;

wherein the counter forms a superior horizontal surface of the master structure;

wherein the pedestal is a disk-shaped structure;

wherein the pedestal forms a horizontal surface;

wherein the pedestal forms an inferior structure of the master structure.

4. The multi-height table and chair set according to claim 3 wherein the bridge lift is an extension apparatus;

wherein the bridge lift is a mechanical device;

wherein the bridge lift adjusts the elevation of the counter;

wherein the bridge lift is designed to maintain the horizontal orientation of the counter as the bridge lift changes the elevation of the counter.

5. The multi-height table and chair set according to claim 4 wherein the control circuit is an electric circuit;

wherein the control circuit controls the operation of the bridge lift;

wherein the control circuit provides the forces necessary to allow the bridge lift to change the elevation of the counter of the master structure;

wherein the personal data device controls the operation of the control circuit.

6. The multi-height table and chair set according to claim 5 wherein the counter comprises a counter superior surface and a counter inferior surface;

wherein the counter superior surface is a congruent end of the disk structure of the counter;

wherein the counter superior surface is the congruent end of the counter that is distal from the counter inferior surface;

wherein the counter inferior surface is a congruent end of the disk structure of the counter;

wherein the counter inferior surface is the congruent end of the counter that is proximal to the pedestal.

7. The multi-height table and chair set according to claim 6 wherein the pedestal comprises a pedestal superior surface and a pedestal inferior surface;

wherein the superior pedestal surface is a congruent end of the disk structure of the pedestal;

wherein the superior pedestal surface is the congruent end of the pedestal that is proximal to the counter;

wherein the pedestal inferior surface is a congruent end of the disk structure of the pedestal;

wherein the pedestal inferior surface is the congruent end of the pedestal that is distal from the pedestal superior surface.

8. The multi-height table and chair set according to claim 7 wherein the bridge lift attaches to the counter inferior surface of the counter;

wherein the bridge lift attaches to the pedestal superior surface of the pedestal.

9. The multi-height table and chair set according to claim 8 wherein the plurality of jack structures comprises a collection of individual jack structures;

wherein each individual jack structure comprises a first hydraulic piston, a second hydraulic piston, and a plurality of hinges;

wherein each of the plurality of hinges makes an attachment selected from the group consisting of: a) attaching the lateral face of the first hydraulic piston to the lateral face of the second hydraulic piston; b) attaching an end of a hydraulic piston selected from the group consisting of the first hydraulic piston and the second hydraulic piston to the counter inferior surface of the counter; c) attaching an end of a hydraulic piston selected from the group consisting of the first hydraulic piston and the second hydraulic piston to the pedestal superior surface of the pedestal;

wherein the first hydraulic piston is further defined with a first end and a second end;

wherein the second hydraulic piston is further defined with a third end and a fourth end;

wherein the first end is an end of the first hydraulic piston of the individual jack structure;

wherein the second end is an end of the first hydraulic piston of the individual jack structure that is distal from the first end;

wherein the third end is an end of the second hydraulic piston of the individual jack structure;

wherein the fourth end is an end of the second hydraulic piston of the individual jack structure that is distal from the third end.

10. The multi-height table and chair set according to claim 9 wherein each individual jack structure is a rotating mechanical device;

wherein each individual jack structure forms a portion of the load path between the counter and the pedestal;

wherein each individual jack structure is identical.

11. The multi-height table and chair set according to claim 10 wherein the first hydraulic piston is a mechanically driven structure;

wherein the first hydraulic piston is a hydraulically driven structure;

wherein the span of the length of the first hydraulic piston varies as a function of the hydraulic pressure provided by the pump to the plurality of jack structures;

wherein the second hydraulic piston is a mechanically driven structure;

wherein the second hydraulic piston is a hydraulically driven structure;

wherein the span of the length of the second hydraulic piston varies as a function of the hydraulic pressure provided by the pump to the plurality of jack structures;

wherein the second hydraulic piston is identical to the first hydraulic piston;

wherein the second hydraulic piston attaches to the first hydraulic piston such that the second hydraulic piston rotates relative to the first hydraulic piston.

12. The multi-height table and chair set according to claim 11 wherein the plurality of hinges comprises a first hinge, a second hinge, a third hinge, a fourth hinge, and a fifth hinge;

wherein the first hinge is a fastening structure;

wherein the first hinge is a rotating structure;

wherein the first hinge attaches the first end of the first hydraulic piston to the counter inferior surface of the counter such that the first hydraulic piston rotates relative to the counter inferior surface;

wherein the second hinge is a fastening structure;

wherein the second hinge is a rotating structure;

wherein the second hinge attaches the second end of the first hydraulic piston to the pedestal superior surface of the pedestal such that the first hydraulic piston rotates relative to the pedestal superior surface;

wherein the third hinge is a fastening structure;

wherein the third hinge is a rotating structure;

wherein the third hinge attaches the third end of the second hydraulic piston to the counter inferior surface of the counter such that the second hydraulic piston rotates relative to the counter inferior surface;

wherein the fourth hinge is a fastening structure;

wherein the fourth hinge is a rotating structure;

wherein the fourth hinge attaches the fourth end of the second hydraulic piston to the pedestal superior surface of the pedestal such that the second hydraulic piston rotates relative to the pedestal superior surface;

wherein the fifth hinge is a fastening structure;

wherein the fifth hinge is a rotating structure;

wherein the fifth hinge attaches the lateral face of the first hydraulic piston to the lateral face of the second hydraulic piston such that the first hydraulic piston rotates relative to the second hydraulic piston.

13. The multi-height table and chair set according to claim 12 wherein the plurality of jack structures further comprises a first jack structure, a second jack structure, third jack structure, and a fourth jack structure;

wherein the first jack structure is a jack structure selected from the plurality of jack structures that transfers a portion of the load of the counter to the pedestal;

wherein the second jack structure is a jack structure selected from the plurality of jack structures that transfers a portion of the load of the counter to the pedestal;

wherein the second jack structure is identical to the first jack structure;

wherein the third jack structure is a jack structure selected from the plurality of jack structures that transfers a portion of the load of the counter to the pedestal;

wherein the third jack structure is identical to the second jack structure;

wherein the fourth jack structure is a jack structure selected from the plurality of jack structures that transfers a portion of the load of the counter to the pedestal;

wherein the fourth jack structure is identical to the third jack structure.

14. The multi-height table and chair set according to claim 13 wherein the control circuit comprises a logic module, a communication module, a manual interface, a pump control, and an external power source;

wherein the communication module further comprises a wireless communication link;

wherein the logic module, the communication module, the manual interface, the pump control, and the external power source are electrically interconnected;

wherein the wireless communication link establishes a communication link between the control circuit and the personal data device.

15. The multi-height table and chair set according to claim 14 wherein the logic module is a programmable electronic device;

wherein the communication module is a wireless electronic communication device that allows the logic module to wirelessly communicate with a personal data device;

wherein the communication module establishes the wireless communication link between the control circuit and the personal data device.

16. The multi-height table and chair set according to claim 15 wherein the manual interface is a collection of electrical switches;

wherein the manual interface allows for the manual adjustment of the elevation of the counter of the master structure when the operation of the personal data device has been disabled;

wherein the pump control is an electric circuit that forms a motor control device;

wherein the logic module controls the operation of the pump control;

wherein the pump control electrically controls the operation of the pump;

wherein the external power source is an externally provided source of electrical energy.

17. The multi-height table and chair set according to claim 16 wherein the table structure is a table that is formed from the master structure;

wherein the counter of the master structure forms the tabletop of the table formed by the table structure;

wherein each of the one or more chair structures is a chair that is formed from the master structure;

wherein the counter of the master structure forms the bench of each chair formed by the one or more chair structures.

* * * * *